US006364366B1

(12) United States Patent
Schwartz

(10) Patent No.: US 6,364,366 B1
(45) Date of Patent: Apr. 2, 2002

(54) SELF TABBING LABEL AND SYSTEM THEREFORE

(75) Inventor: David C. Schwartz, Southboro, MA (US)

(73) Assignee: Productive Environments, Inc., Framingham, MA (US)

( * ) Notice: Subject to any disclaimer, the term of this patent is extended or adjusted under 35 U.S.C. 154(b) by 0 days.

(21) Appl. No.: 09/551,472

(22) Filed: Apr. 18, 2000

Related U.S. Application Data

(63) Continuation-in-part of application No. 29/100,842, filed on Feb. 19, 1999.

(51) Int. Cl.[7] ..... B42D 15/00

(52) U.S. Cl. ..... 283/81; 402/79; 283/81; 283/101; 283/37; 283/39

(58) Field of Search ..... 283/36–42, 79, 283/80, 81, 101, 56, 105; 402/70, 73, 79; 281/38

(56) References Cited

U.S. PATENT DOCUMENTS 4,978,143 A * 12/1990 Ericson ..... 283/39 X
5,462,783 A * 10/1995 Esselmann ..... 283/39 X
5,695,219 A * 12/1997 Crawford ..... 283/39
5,947,525 A * 9/1999 Pullman ..... 283/39 X

* cited by examiner

*Primary Examiner*—Willmon Fridie, Jr.

(57) ABSTRACT

A composite label sheet, is provided for comprising:

a face sheet having perimeter features and having first and second sides, said first side having at least one or more regions, each region comprising a die cut self tabbing label, said each of said die cut self tabbing labels comprising an upper tab portion, a lower tab portion connected thereto, and a base portion connected to said lower tab portion;

a coating of pressure sensitive adhesive disposed on said second side of said face sheet; and a liner having two sides, a first side and a second side, said liner having perimeter features substantially equal to said face sheet, where said first side of said liner is attached to said second side of said face sheet pressure sensitive adhesive, said first side of said liner having its face adapted to be releasably fixed to said pressure sensitive adhesive, such that said each of said at least one regions of die cut self tabbing labels is thereby separable from said releasably adapted face of said liner.

10 Claims, 8 Drawing Sheets

SELF TABBING LABEL AND SYSTEM THEREFORE

This provisional patent application is a continuation in part of Design U.S. Pat. No. 29/100,842 Tabbed Label filed Feb. 2, 1999.

BACKGROUND OF THE INVENTION

This invention relates to labels, and in particular to labels which have pressure sensitive adhesive on one side which are used as tabs or indexes, having a portion of the label which protrudes from the edge of a host sheet to which it is attached. The invention further relates to the delivery of such self tabbing labels on a release coated sheet in combination with wirebound books and for use as accessory labeling sheets in combination with ringed binders.

This invention relates to self tabbing labels formed with pressure sensitive adhesive on the entire back portion but with only an upper and lower tab portion attached to a base portion, where the hinge axis for folding the upper portion onto the lower portion is equidistant from the edge of the upper and lower tab portions. This invention relates to self tabbing labels where the hinge axis between upper and lower tab portions has a fold hint for encouraging a straight fold of the upper tab portion onto the lower tab portion. The new aspect here is a fold hint which is marked not only with printed indicia, but alternatively is marked by way of a score, fold perforation with sufficient landed area between perfs to prevent tearing but to ease folding by weakening the papers fibers, and to a fold hint formed by an extended detent in the hinge portion from one or both sides of the label edge. This invention relates to self tabbing labels formed with oversized base portions for printing or drawing upon. The oversized portion may be rectangular or have a preferred shape. Thus this invention relates to such self tabbing labels formed according to this invention, which may be customized or mass customized by way of marking or shaping the oversized tab portion, such as printing of icons or images, for example sports objects like base balls, soccer, bails, foot balls and the like, thereon, or otherwise shaping the oversized portion in the form of such a sports object. The invention relates to columns or arrays of such self tabbing labels delivered on a release coated sheet where said release coated sheet is punched for use in a wirebound book or for use with a ringed binder, and to the combination of such a release coated sheet comprising self tabbing labels according to this invention in combination with wirebound books, master label marking sheets, and margin marked separator leaves or in combination with master label marking sheets and margin marked separator leaves for use as accessory to a ringed binder or in combination with a ringed binder.

Self tabbing labels have been available with symmetrical sets of hinged tabs and base portions, where the hinge axis is equidistant from the outer perimeter edge of the respective base portions, and where the entire back portion of the tab configuration is coated with pressure sensitive adhesive. In addition, self tabbing labels have been available where there is a base portion coated with adhesive on the reverse side, and there is a tab portion adjoining said base portion that is free of adhesive. The problem with the self tabbing labels with symmetrical tab and base portions on either side of the hinge axis is that the label is larger, using more material. It is more difficult to fold these over and get them to align evenly since you are handling a larger adhesive portion of material. The hinge axis does not provide for a fold hint in these prior art variations. Further, the base portion is limited in size, preventing the use of the base portion as a differentiating characteristic of the label. Labels that provide for a base portion with adhesive and a tab portion with no adhesive can use half the material than the symmetrical type, but are more expensive to form due to the fact that the material needs to have a banded strip of adhesive applied. Typically, this label type needs to be formed from stiffer material since there is not a fold over portion which serves to strengthen the label. This also raises the cost of the label. Self tabbing labels have not provided an oversized base portion or an oversized base portion which has a distinctive shape, thereby limiting their use to the tab portion as the sole basis for making the label visually differentiated. Wire books have been provided for where the pages are pre separated by dividers, and where the page count between dividers is preset. Such preset page counts often do not anticipate the requirements of the user who would otherwise choose to tab a section with an application specific division of pages. Binder index tabs have been available which have multi-cut tabs which are precollated according to tab position and provided for as a set. These kits are expensive to produce requiring a die cut for each divider and requiring collating by tab position in packaging.

SUMMARY OF THE INVENTION

The invention therefore relates to self tabbing labels covered on one side with pressure sensitive adhesive, which are comprised solely of an upper and a lower tab portion used for marking hingedly attached one to the other, which when folded over with the upper portion folded over onto the lower portion forms a section which protrudes from a host sheet to which it is attached, where the lower base portion is coterminous with a base portion which is used to attach the self tabbing label to a host sheet. The invention further relates to self tabbing labels where the hinge axis between the upper and lower portions has a fold hint therein. The invention further relates to such self tabbing labels where the base portion is oversized and may also take on a distinctive shape.

It is the object of this invention to provide a self tabbing label which has only an upper and lower tab portion for folding over to provide the tab portion that protrudes from the edge of a host page to which it is attached. By requiring that only the upper portion be folded over reduces material costs, increases packing density of labels by shrinking the overall size of the label, and improves ease of use in both marking and applying the label to the host page. Further, by retaining the upper and lower portion, the tab portion that extends outside the sheet is reinforced, being double thickness once folded over, a feature that is appealing to the touch.

It is the object of this invention to provide a fold hint which makes it easy for the user to fold the upper portion of the tab onto the lower portion of the tab. By providing the fold hint, the label can be perfectly folded, a requirement for keeping a categorized book looking neat.

It is a further object of this invention to provide an enlarged base area which also may take on an application specific shape. By providing the enlarged base portion as an option, this base portion increases label adhesion by using a larger surface area for attaching to the host sheet. The area also provides for personalization with drawing, marking or imprinting, and for categorization according to shape, where the shape of the base portion can be used to differentiate each label, one from the next. By offering a larger base area, application or category specific printing may further be used to improve label differentiation. Labeling by type, where the label itself can be easily be distinguished one from another is considered an important improvement and useful feature in assisting the user to associate each label with a different contents.

Yet an additional object of this invention is to provide for a wire bound book with selftabbing features. Such a wire-bound book would be comprised of a self tabbing sheet according to this invention, wired into the wirebound book either in front of the book cover or directly after the book cover. The cover can be marked as a master contents sheet on the outer margin edge with lines for entering tabbed section contents, where the lines are separated to allow for subsequent positioning of labels aligned with such contents line on leaves following the master contents sheet. Alternatively, a master contents sheet can be incorporated in the wire book following the release coated sheet comprising an array or column of pressure sensitive labels, for recording the contents at the "top level" of the book, allowing quick reference to the named contents sections of the categorization. The leaves of the book can be provided with hash markings along the outer margin edge to show positions for aligning labels. Alternatively, separator pages can be wired in with leaves with predetermined page counts between separator pages, and separator pages may be hash marked along their outer margin edge to show position locations for the self tabbing labels. This form of book provides for a user separable categorization of the book without having to precollate or deterministically separate pages by section. A further version of this type would provide for the selftabbing label sheet and a master label sheet and separator sheets as a kit for use with and attachment to a ringed binder.

In accordance with this invention what is provided is (see detailed description of the invention).

BRIEF DESCRIPTION OF THE DRAWINGS

The above and other objects and advantages of the invention will be apparent from consideration of the following detailed description, taken to conjunction with the accompanying drawings, in which like reference characters refer to like parts throughout and in which: FIGS:

FIG. 17 Shows a sample leaf with posting marks for aligning labels there on.

DETAILED DESCRIPTION OF THE INVENTION

Figure 1:
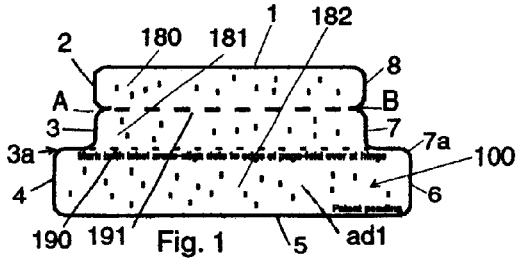
FIG. 1 Shows a self tabbing label according to this invention with upper and lower tab portions separated by a fold hint comprising printed indicia as a dotted line and having a standard sized base with extended knees.
Figure 2:
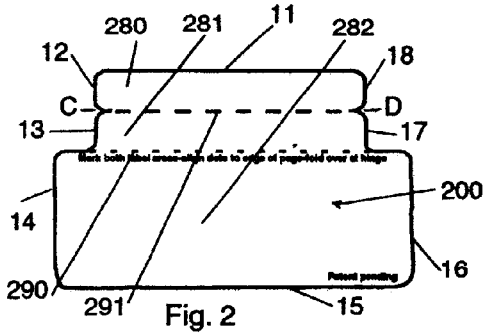
FIG. 2 Shows a self tabbing label according to this invention with upper and lower tab portions separated by a fold hint comprising printed indicia as a dotted line and having an oversized base with extended knees.
Figure 3:
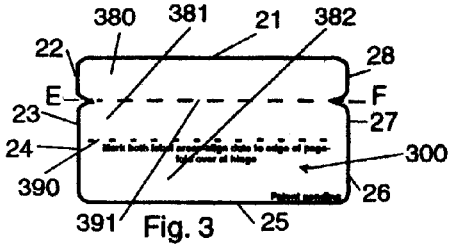
FIG. 3 Shows a self tabbing label according to this invention with upper and lower tab portions separated by a fold hint comprising printed indicia as a dotted line and having a standard base with base width matching label width.
Figure 4:
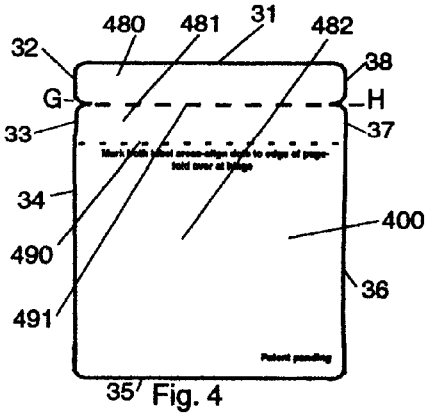
FIG. 4 Shows a self tabbing label according to this invention with upper and lower tab portions separated by a fold hint comprising printed indicia as a dotted line and having an oversized base width with base width matching label width.
Figure 5:
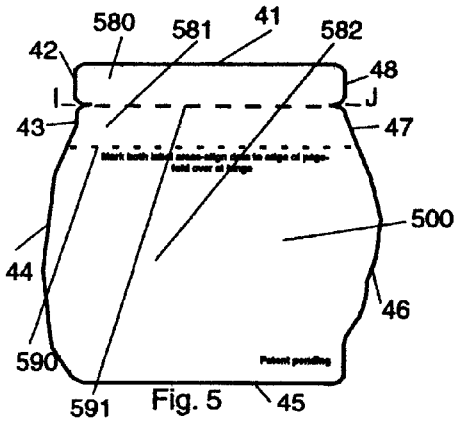
FIG. 5 Shows a self tabbing label according to this invention with upper and lower tab portions separated by a fold hint comprising printed indicia as a dotted line and having an oversized base of a distinctive shape.
Figure 6:
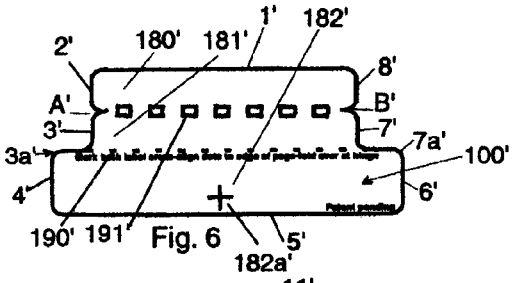
FIG. 6 Shows a self tabbing label according to this invention with upper and lower tab portions separated by a fold hint comprising a perforated fold hint with sufficient landed area between perforations to facilitate folding without tearing and having a standard sized base with extended knees.
Figure 7:
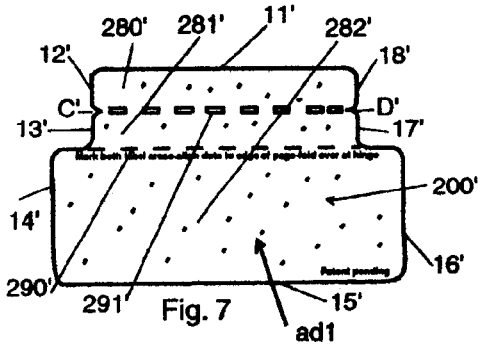
FIG. 7 Shows a self tabbing label according to this invention with upper and lower tab portions separated by a fold hint comprising a perforated fold hint with sufficient landed area between perforations to facilitate folding without tearing and having an oversized base with extended knees.
Figure 8:
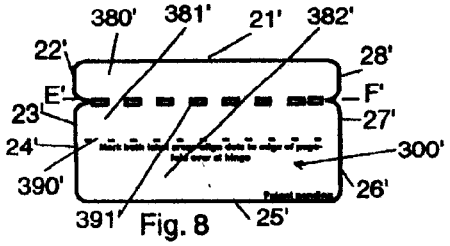
FIG. 8 Shows a self tabbing label according to this invention with upper and lower tab portions separated by a fold hint comprising a perforated fold hint with sufficient landed area between perforations to facilitate folding without tearing and having a standard base with base width matching label width.
Figure 9:
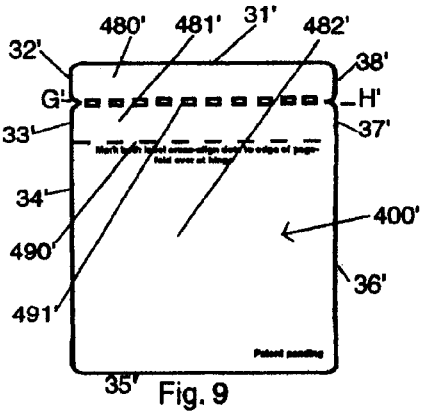
FIG. 9 Shows a self tabbing label according to this invention with upper and lower tab portions separated by a fold hint comprising a perforated fold hint with sufficient landed area between perforations to facilitate folding without tearing and having an oversized base with base width matching label width.
Figure 10:
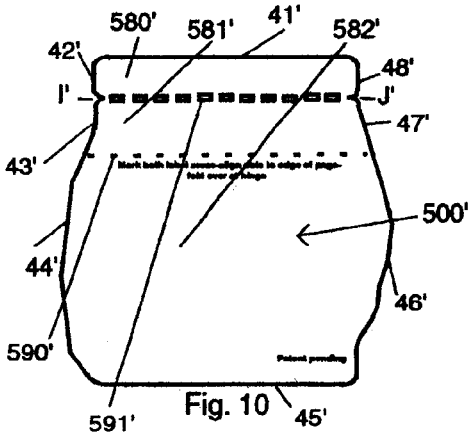
FIG. 10 Shows a self tabbing label according to this invention with, upper and lower tab portions separated by a fold hint comprising a perforated fold hint with sufficient landed area between perforations to facilitate folding without tearing and having an oversized base of a distinctive shape.
Figure 11:
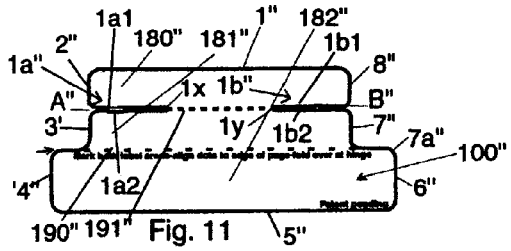
FIG. 11 Shows a self tabbing label according to this invention with upper and lower tab portions separated by a fold hint comprising a fold hint with detent slits on either end of the label hinge axis, protruding into the label tab area between the upper and lower tab portions to facilitate folding without tearing and having a standard sized base with extended knees.

A preferred embodiment of the invention is shown in FIG. 7 where the self tabbing label, 200', has a perimeter formed by extents 11', 12', 13', 14', 15', 16', 17', and 18'. The self tabbing label has a pressure sensitive adhesive and on one side and a marking area on the face side. The label has an upper tab portion 280', lower tab portion 281', and a base portion 282'. The upper tab portion 280' is symmetrically matched by a lower tab portion 281'. Reflected through and rotatably attached about a hinge axis c'–d'. The hinge has a fold hint comprising a perforation formed with landed areas such that the perforation, 291', is easily folded but does not tear. Indicia 290' assists in aligning the edge of the self tabbing label to a host sheet along an outer margin edge of said host sheet. The oversized base area 282', is of sufficient size for marking or printing on.

Figure 12:
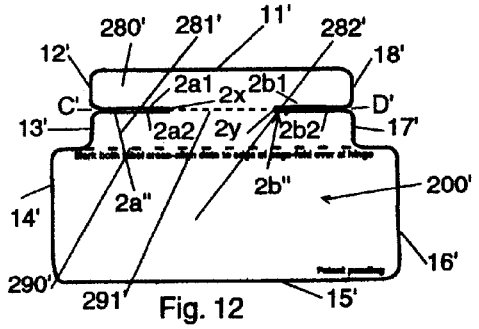
FIG. 12 Shows a self tabbing label according to this invention with upper and lower tab portions separated by a fold hint comprising a fold hint with detent slits on either end of the label hinge axis, protruding into the label tab area between the upper and lower tab portions to facilitate folding without tearing and having an oversized base with extended knees.
Figure 13:
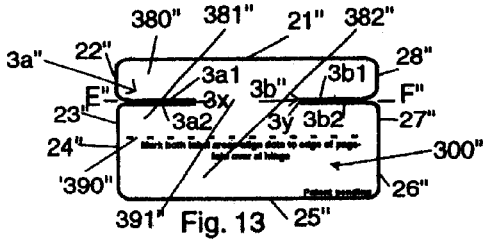
FIG. 13 Shows a self tabbing label according to this invention with upper and lower tab portions separated by a fold hint comprising a fold hint with detent slits on either end of the label hinge axis, protruding into the label tab area between the upper and lower tab portions to facilitate folding without tearing and additionally having a fold hint comprising a standard base with base width matching label width perforated fold hint with sufficient landed area between perforations to facilitate folding, and having a standard base with base width matching label width.
Figure 14:
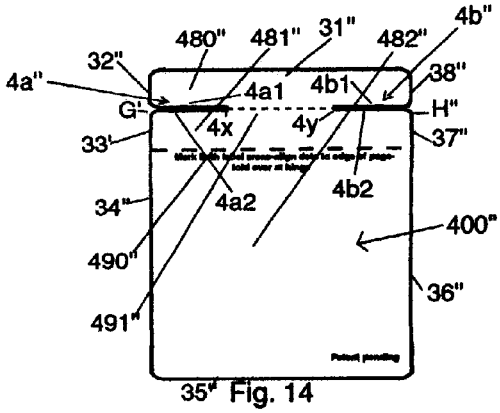
FIG. 14 Shows a self tabbing label according to this invention with upper and lower tab portions separated by a fold hint comprising a fold hint with detent slits on either end of the label hinge axis, protruding into the label tab area between the upper and lower tab portions to facilitate folding without tearing and having an oversized base with base width matching label width.
Figure 15:
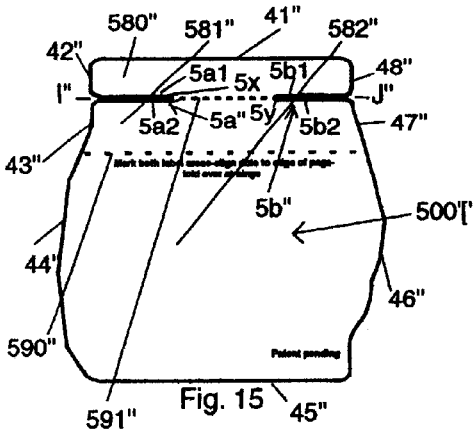
FIG. 15 Shows a self tabbing label according to this invention with upper and lower tab portions separated by a fold hint comprising a fold hint with detent slits on either end of the label hinge axis, protruding into the label tab area between the upper and lower tab portions to facilitate folding without tearing and having an oversized base of a distinctive shape.

In another preferred embodiment, as in FIG. 12., the detents 2*a*" and 2*b*" are of sufficient extent to more easily enable the folding of the upper portion over the lower portion with or without the use of a landed fold perforation.

Figure 16:
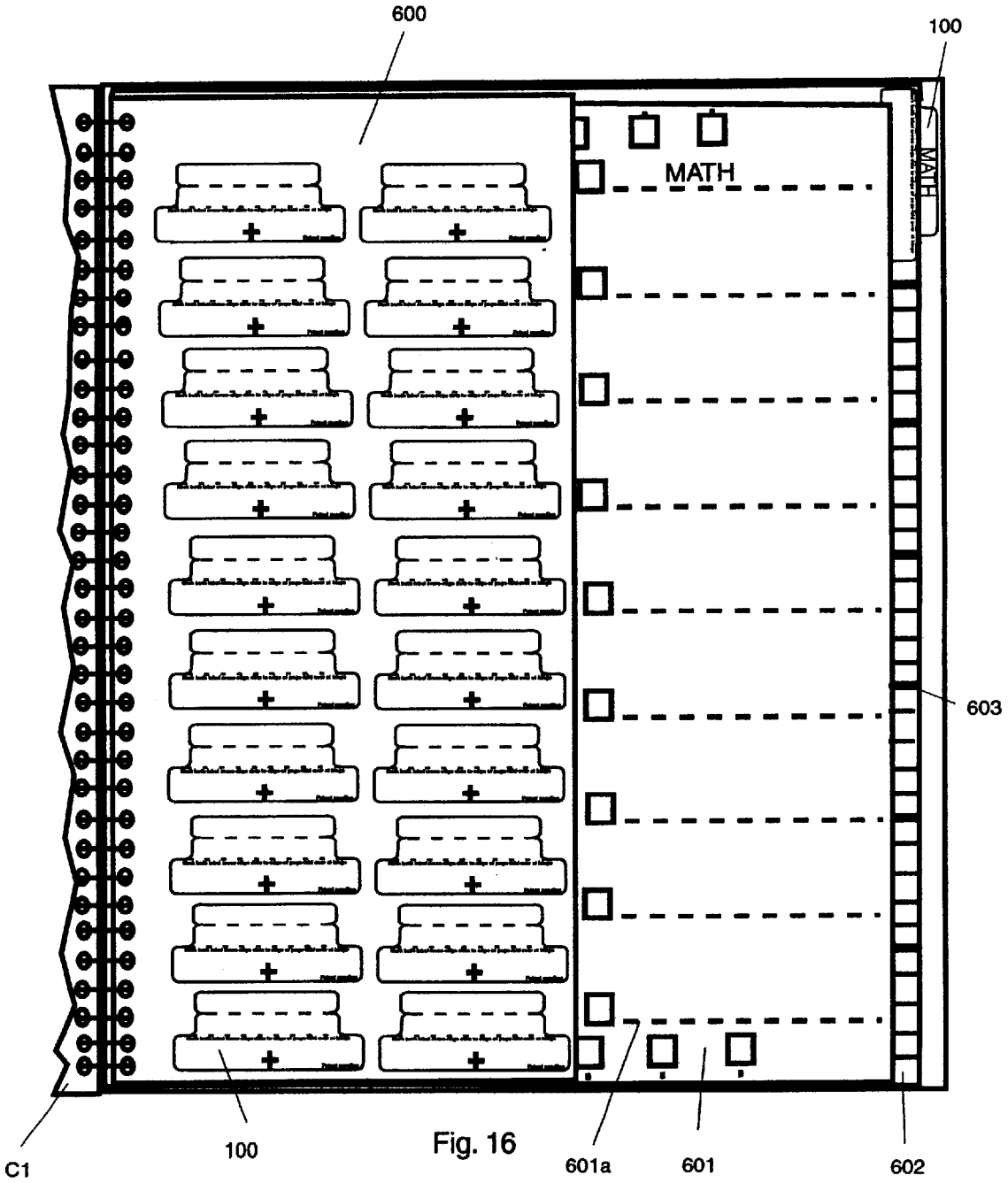
FIG. 16 Shows a wirebound book comprising a label sheet with pressure sensitive self tabbing labels in an array on a release coated paper in combination with a master categorization sheet with locations for listing label content, and leaves premarked for posting labels. A sample label marked math is disposed on the first leaf following the master table.
Figure 17:
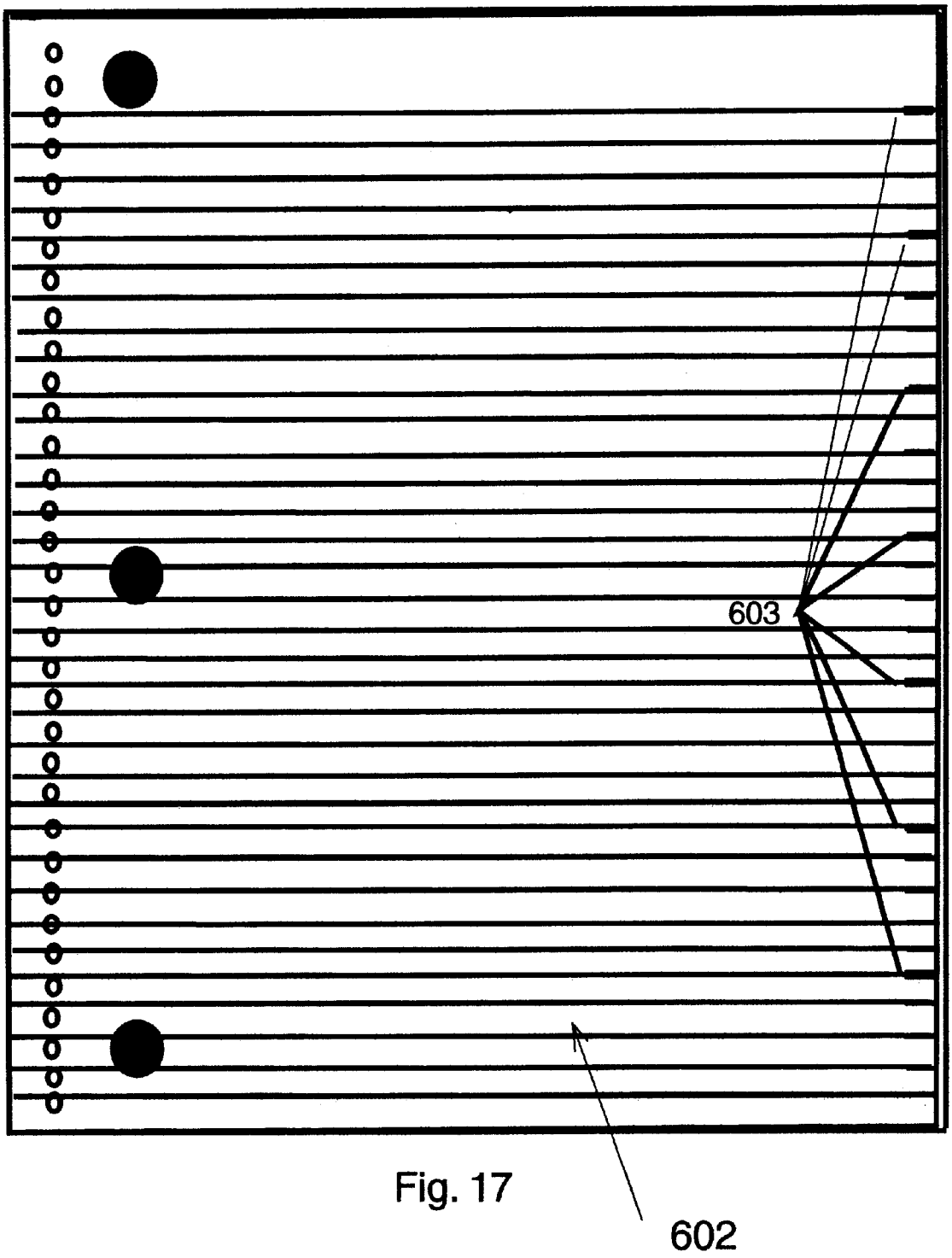
Figure 18:
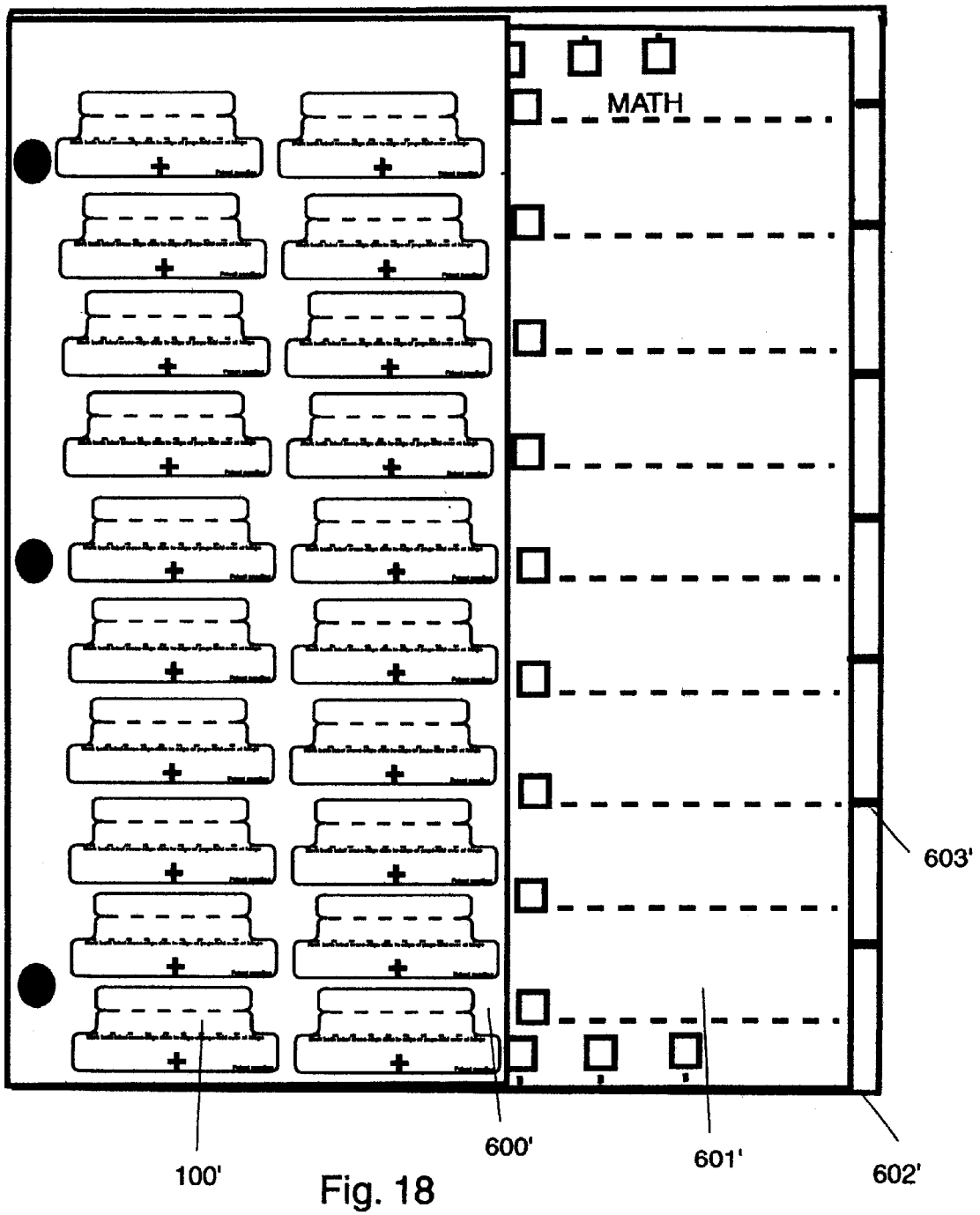
FIG. 18 Shows a pack formed for use as an accessory to a three holed binder, comprising a label sheet with pressure sensitive self tabbing labels in an array on a release coated paper in combination with a master categorization sheet with locations for listing label content, and leaves premarked for posting labels.
Figure 19A:
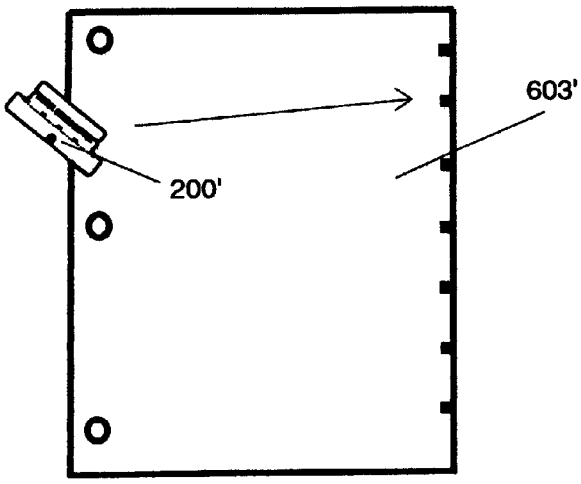
FIG. 19*a* Shows a host leaf with markings for attaching a label and a sample label which is about to be attached thereto.
Figure 19B:
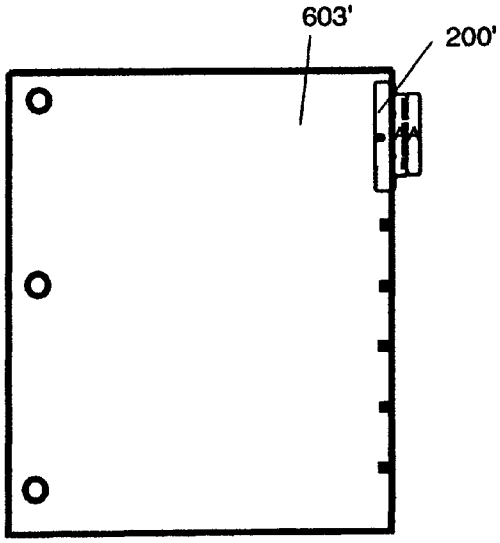
FIG. 19*b* Shows the host leaf of 19*a* where the label is attached but the upper tab portion is not yet folded over.
Figure 19C:
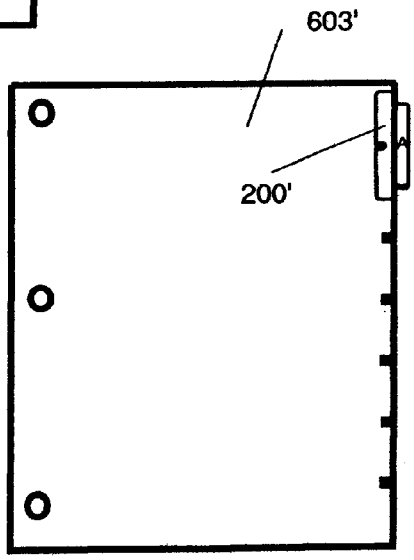
FIG. 19*c* Shows the host leaf of 19*b* where the upper tab portion is folded over onto the lower tab portion.
Figure 20:
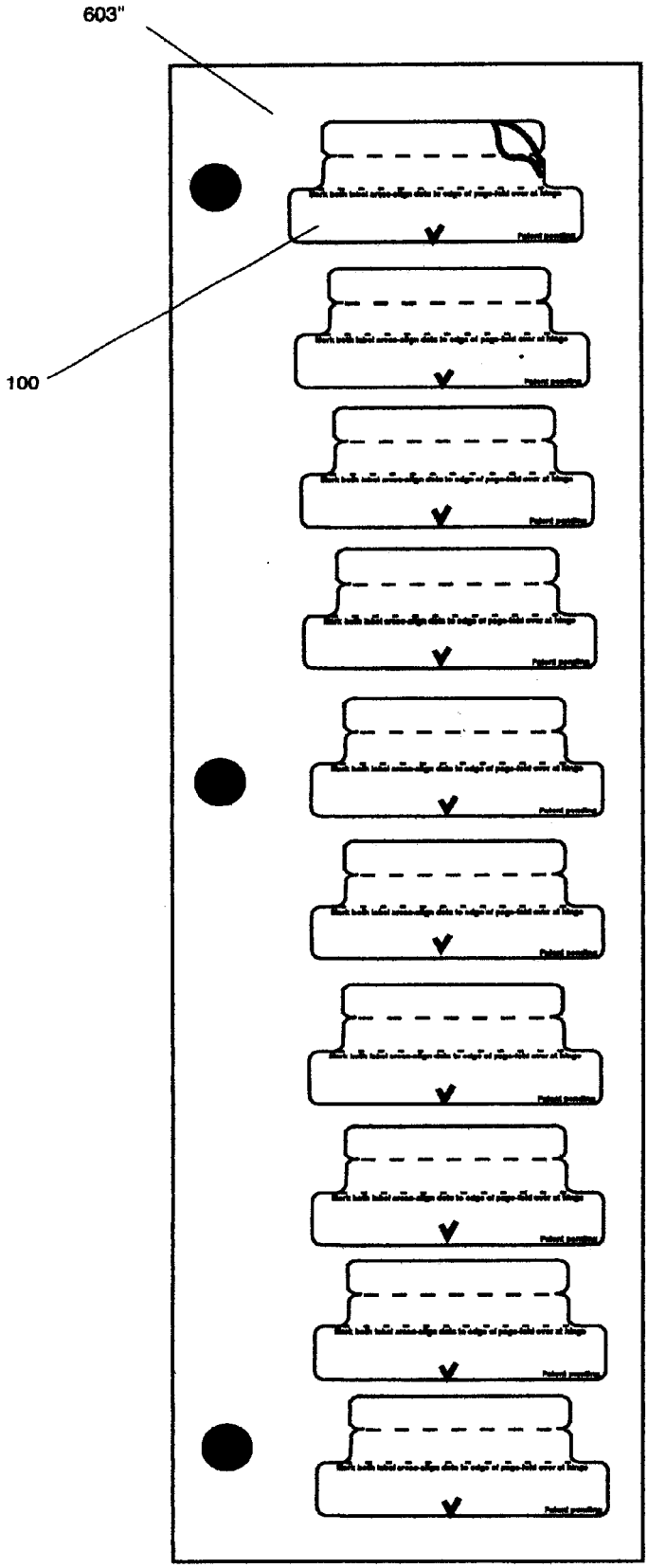
FIG. 20 Shows a release coated sheet with a column of pressure sensitive labels, where the top label is being peeled back for removal from the host sheet holding the label columns.

A preferred combination is a wirebound book configured with a pressure sensitive label sheet of self tabbing labels according to the invention, each peelable therefrom, a master sheet for listing categories, and leaves of the book with optional hash markings for positioning, labels thereon, or with separator pages with optional hash markings for positioning labels thereon in combination with paper leaves therebetween. The label sheet can follow the cover of the book as shown in FIG. 16, or categorization sheet 601 can be made of sufficiently strong writable (write on wipe off or simply paper board write on) material to form the cover and the label sheet can follow it. The above mentioned self tabbing pressure sensitive label sheet and master category sheet may be formed with punched hole edges, as may be the separator sheets, master category sheet, and leaves to comprise a package bundled together for use in combination with a binder.

Archiving is an important step in any document handling application. A binder accessory kit comprising a large count self tabbing label sheet and colored or color coded separator pages all punched for attachment to a binder would make an ideal, low cost, consumable label system for helping keep work, particularly archival work, organized in a binder. The use of separator pages that do not have to have separate dies for each tab position and which do not have to be collated prior to packaging makes this a low cost alternative which is very easily packaged in large quantities of indexable material.

A wire book is a preconfigured combination of paper and cover, where the paper cannot easily be added once the paper count has been final wired. In use, separation is often made with separator sheets which are placed at predetermined page counts, one from the next. The limitation of predetermined page counts is that either too few or too many pages may be grouped in the particular SKU. The advantage of the present invention when combined in a wire book is that the consumer can choose the predetermined page separation between categories and mark them accordingly. Since wirebooks can easily be formed with the cover width slightly wider than the papers, the preferred embodiment of this combination would have covers wide enough to protect the extended or protruding portion of the label tab portion.

What is claimed is:

1. In combination, a wire book having a wire binding means, said wire book comprising a self-tabbing label sheet and a set of leaves of uniform size and shape, said self-tabbing label sheet and said set of leaves having a common binding edge and a plurality of unbound edges, said common binding edge bound by said wire of said wirebook, said self tabbing label sheet comprising at least one die cut self tabbing label having perimeter features and having first and second sides, said at least one die cut self tabbing label comprising perimeter features with an upper tab portion, a lower tab portion connected thereto, and a base portion connected to said lower tab portion, where said upper tab portion and said lower tab portion each having perimeter features including a set of edges, where said upper tab portion and said lower tab portion are of uniform size and shape , and where said upper tab portion is connected to said lower tab portion along a common edge, a hinge fold edge, said hinge fold edge further comprising a fold axis, for enabling the folding of said upper tab portion onto said lower tab portion, said self tabbing label further comprising a base portion of size at least substantially equal said one of said upper or lower tab portions, and having perimeter features including a set of edges, said base portion being connected to said lower tab portion along a common edge between said lower tab portion and said base portion, said self tabbing label having a coating of pressure sensitive adhesive disposed on a side thereof; said self tabbing label sheet further comprising a liner having two sides, a first side and a second side, said liner having perimeter features, where said first side of said liner is attached to said self tabbing label pressure sensitive adhesive, said first side of said liner having its face adapted to be releasably fixed to said pressure sensitive adhesive, such that said each of said at least one die cut self tabbing labels is thereby separable from said releasably adapted face of said liner, said set of uniform leaves comprising at least:

a master category sheet having a binding edge and a plurality of unbound edges in common with said leaves and formed with a plurality of category indicia lines for listing category names in a label marking area said each of said category indicia lines located at uniform intervals along a selected one of said unbound edges, and a set of one or more leaves.

2. In combination, a wire book having a wire binding means, said wirebook comprising a front cover, a rear cover, a self tabbing label sheet,and a set of leaves of uniform size and shape, said each of said front cover, said rear cover, said self tabbing label sheet, and said set of leaves having a common binding edge and a plurality of unbound edges, said common binding edge bound by said wire of said wirebook, said front cover comprising a master category sheet said master category sheet formed with a plurality of category indicia lines for listing category names in a label marking area said each of said category indicia lines located at uniform intervals along a selected one of said unbound edges, a self tabbing label sheet comprising at least one die cut self tabbing label having perimeter features and having first and second sides, said at least one die cut self tabbing label comprising perimeter features with an upper tab portion, a lower tab portion connected thereto, and a base portion connected to said lower tab portion where said upper tab portion and said lower tab portion each having perimeter features including a set of edges, where said upper tab portion and said lower tab portion are of uniform size and shape , and where said upper tab portion is connected to said lower tab portion along a common edge, a hinge fold edge, said hinge fold edge further comprising a fold axis, for enabling the folding of said upper tab portion onto said lower tab portion, said self tabbing label further comprising a base portion of size at least substantially equal said one of said upper or lower tab portions, and having perimeter features including a set of edges, said base portion being connected to said lower tab portion along a common edge between said lower tab portion and said base portion, said self tabbing label having a coating of pressure sensitive adhesive disposed on a side thereof; said self tabbing label further comprising a liner having two sides, a first side and a second side, said liner having perimeter features, where said first side of said liner is attached to said self tabbing label pressure sensitive adhesive, said first side of said liner having its face adapted to be releasably fixed to said pressure sensitive adhesive, such that said each of said self tabbing labels is thereby separable from said releasably adapted face of said liner, and a set of one or more leaves.

3. In combination, a wire book having a wire binding means, said wirebook comprising a front cover , a rear cover, a self tabbing label sheet, and a set of leaves of uniform size and shape, said each of said front cover, said rear cover, said self tabbing label sheet, and said set of leaves having a common binding edge and a plurality of unbound edges, said common binding edge bound by said wire of said wirebook, said self tabbing label sheet comprising at least one die cut self tabbing label having perimeter features and having first and second sides, said at least one die cut self tabbing label comprising perimeter features with an upper tab portion, a lower tab portion connected thereto, and a base portion connected to said lower tab portion where said upper tab portion and said lower tab portion each having perimeter features including a set of edges, where said upper tab portion and said lower tab portion are of uniform size and shape, and where said upper tab portion is connected to said lower tab portion along a common edge, a hinge fold edge, said hinge fold edge further comprising a fold axis, for enabling the folding of said upper tab portion onto said lower tab portion, said self tabbing label further comprising a base portion of size at least substantially equal said one of said upper or lower tab portions, and having perimeter features including a set of edges, said base portion being connected to said lower tab portion along a common edge between said lower tab portion and said base portion. Said self tabbing label having a coating of pressure sensitive adhesive disposed on a side thereof; said self tabbing label sheet further comprising a liner having two sides, a first side and a second side, where said first side of said liner is attached to said self tabbing label pressure sensitive adhesive, said first side of said liner having its face adapted to be releasably fixed to said pressure sensitive adhesive, such that said each of said at least one self tabbing labels is thereby separable from said releasably adapted face of said liner;

and a set of one or more leaves where in said each of said leaves is formed with a plurality of leaf edge marking lines for locating and positioning a self tabbing label, said each of said leaf edge marking lines located at uniform intervals along a selected one of said unbound edge.

4. In combination, a self tabbing label sheet and a a set of leaves of uniform size and shape, said self tabbing label sheet and said set of one or more leaves having a common binding edge and a plurality of unbound edges, said common binding edge being punched for attachment to a ringed binder, said self tabbing label sheet comprising at least one die cut self tabbing label having perimeter features and having first and second sides , said at least one die cut self tabbing label comprising perimeter features with an upper tab portion, a lower tab portion connected thereto, and a base portion connected to said lower tab portion, where said upper tab portion and said lower tab portion each having perimeter features including a set of edges, where said upper tab portion and said lower tab portion are of uniform size and shape , and where said upper tab portion is connected to said lower tab portion along a common edge, a hinge fold edge, said hinge fold edge further comprising a fold axis, for enabling the folding of said upper tab portion onto said lower tab portion, said self tabbing label further comprising a base portion of size at least substantially equal said one of said upper or lower tab portions, and having perimeter features including a set of edges, said base portion being connected to said lower tab portion along a common edge between said lower tab portion and said base portion, said self tabbing label having a coating of pressure sensitive adhesive disposed on a side thereof; and a liner having two sides, a first side and a second side, where said first side of said liner is attached to said self tabbing label pressure sensitive adhesive, said first side of said liner having its face adapted to be releasably fixed to said pressure sensitive adhesive, such that said each of said at least one self tabbing labels is thereby separable from said releasably adapted face of said liner;

said each of said leaves for binding along a common edge comprising an unbound edge having a plurality of label marking areas located at uniform intervals along a selected one of said unbound edges at a uniform distance of separation there from for identifying the location wherein to attach said selftabbing label thereto.

5. In combination, a self tabbing label sheet, a master category sheet, and a a set of sheets of uniform size and shape, said self tabbing label sheet, said master category sheet and said set of sheets having a common binding edge and a plurality of unbound edges, said common binding edge being punched for attachment to a ringed binder, said self tabbing label sheet comprising at least one die cut self tabbing label having perimeter features and having first and second sides , said at least one die cut self tabbing label comprising perimeter features with an upper tab portion, a lower tab portion connected thereto, and a base portion connected to said lower tab portion, where said upper tab portion and said lower tab portion each having perimeter features including a set of edges, where said upper tab portion and said lower tab portion are of uniform size and shape , and where said upper tab portion is connected to said lower tab portion along a common edge, a hinge fold edge, said hinge fold edge further comprising a fold axis, for enabling the folding of said upper tab portion onto said lower tab portion, said self tabbing label further comprising a base portion of size at least substantially equal said one of said upper or lower tab portions, and having perimeter features including a set of edges, said base portion being connected to said lower tab portion along a common edge between said lower tab portion and said base portion, said self tabbing label having a coating of pressure sensitive adhesive disposed on a side thereof; said self tabbing label sheet further comprising a liner having two sides, a first side and a second side, where said first side of said liner is attached to said self tabbing label pressure sensitive adhesive, said first side of said liner having its face adapted to be releasably fixed to said pressure sensitive adhesive, such that said each of said at least one self tabbing labels is thereby separable from said releasably adapted face of said liner; where said master category sheet comprises a plurality of category indicia lines along one of said unbound edges thereof for listing category names in a label marking area, said each of said category indicia lines located at uniform intervals along a selected one of said unbound edges and said set of one or more sheets of uniform size comprising a set of leaves for marking with self tabbing labels and for recording additional information thereon.

6. The combination of claim 1 wherein the the self tabbing label fold axis is comprised of a hinge structure, where said hinge structure is selected from the group consisting of, (a.) Printed indicia, (b.) Score markings, (c.) A perforated fold demarkation, and (d.) Cuts formed in the common edge between said upper tab portion and said lower tab portion on either end of said hinge axis.

7. The combination of claim 2 wherein the the self tabbing label fold axis is comprised of a hinge structure, where said hinge is structure selected from the group consisting of, (a.) Printed indicia, (b.) Score markings, (c.) A perforated fold demarkation, and (d.) Cuts formed in the common edge between said upper tab portion and said lower tab portion on either end of said hinge axis.

8. The combination of claim 3 wherein the the self tabbing label fold axis is comprised of a hinge structure, where said hinge structure is selected from the group consisting of, (a.) Printed indicia, (b.) Score markings, (c.) A perforated fold demarkation, and (d.) Cuts formed in the common edge between said upper tab portion and said lower tab portion on either end of said hinge axis.

9. The combination of claim 4 wherein the the self tabbing label fold axis is comprised of a hinge structure, where said hinge structure is selected from the group consisting of, (a.) Printed indicia, (b.) Score markings, (c.) A perforated fold demarkation, and (d.) Cuts formed in the common edge between said upper tab portion and said lower tab portion on either end of said hinge axis.

10. The combination of claim 5 wherein the the self tabbing label fold axis is comprised of a hinge structure, where said hinge structure is selected from the group consisting of, (a.) Printed indicia, (b.) Score markings, (c.) A perforated fold demarkation, and (d.) Cuts formed in the common edge between said upper tab portion and said lower tab portion on either end of said hinge axis.

* * * * *